US007077817B2

(12) United States Patent
Young et al.

(10) Patent No.: US 7,077,817 B2
(45) Date of Patent: Jul. 18, 2006

(54) SELF-ADMINISTERED TWO-HANDLED PROBE FOR TREATING PROSTATITIS

(76) Inventors: Leparis D. Young, 84-1389 Maunaolu St., Waianae, HI (US) 96792; John Polacheck, 1701 W. St Mary's Rd. Ste. 102, Tucson, AZ (US) 85745

( * ) Notice: Subject to any disclaimer, the term of this patent is extended or adjusted under 35 U.S.C. 154(b) by 693 days.

(21) Appl. No.: 10/242,837

(22) Filed: Sep. 11, 2002

(65) Prior Publication Data

US 2003/0078524 A1 Apr. 24, 2003

Related U.S. Application Data

(60) Provisional application No. 60/328,936, filed on Oct. 10, 2001.

(51) Int. Cl.
*A61H 19/00* (2006.01)
*A61H 7/00* (2006.01)

(52) U.S. Cl. ..... 601/135

(58) Field of Classification Search ..... 601/135; 128/842; 514/12; 606/197
See application file for complete search history.

(56) References Cited

U.S. PATENT DOCUMENTS

| | | | | |
|---|---|---|---|---|
| 868,522 | A | 10/1907 | Barker | |
| 1,327,786 | A | 1/1920 | Stephan | |
| 2,263,219 | A | 11/1941 | Lybarger | |
| 2,445,974 | A * | 7/1948 | Schwartz | 601/135 |
| 2,477,666 | A | 8/1949 | Smallen | |
| 2,478,786 | A | 8/1949 | Smallen | |
| 2,657,687 | A * | 11/1953 | Bonham | 601/135 |
| 3,451,391 | A | 6/1969 | Tavel | |
| 3,669,100 | A | 6/1972 | Csanad | |
| 4,002,164 | A | 1/1977 | Bradley | |
| 4,911,149 | A | 3/1990 | Borodulin | |
| 5,730,708 | A | 3/1998 | Spratt | |

(Continued)

*Primary Examiner*—Vy Bui
(74) *Attorney, Agent, or Firm*—Leighton K. Chong; Godbey Griffiths Reiss & Chong

(57) ABSTRACT

A probe apparatus for self-administered treatment of prostatitis has a pair of opposing handle bars symmetrical to each other having handle grip ends and connected to a center housing along a common axis, and a probe connected to a front side of the center housing and extending to a probe tip. The center housing has a vibrator motor which is mechanically coupled to the probe tip, and is actuated by a switch on one of the handle grip ends. The probe has a swivelable tip actuated by a pair of swivel actuators provided on the handle grip ends. The probe tip has an off-center bulbous or ovoid shape for effecting a sweeping movement over the prostate when a swivel actuator is actuated. The probe and the handle grip ends have approximately the same length and extend in the same direction for more precise manipulation by the patient. The handle bars are connected to the center housing by twist-lock disconnectors to be detachable for storage or packing. The probe apparatus is employed by inserting the probe into the rectum from the rear of the patient, and positioning the probe tip adjacent the colon walls proximate the prostate while manipulating the handle grip ends on each side of the patient. It is employed with the patient in a standing, bent over position, and a mirror is placed on the floor between the patient's feet to provide visual confirmation of the position of the probe. The probe apparatus is effective for prostatitic drainage by manipulating the swivel actuators to sweep over the surface areas of the prostate toward the prostate center in order to drain fluid from the prostate gland and ducts.

9 Claims, 6 Drawing Sheets

U.S. PATENT DOCUMENTS 5,797,950 A 8/1998 Takashima
5,848,980 A 12/1998 Demerais
5,861,000 A 1/1999 Takashima
6,110,102 A 8/2000 Harrison
6,261,251 B1 7/2001 Meyers

* cited by examiner

URETHRA
PROSTATE
PROBE TIP
(TURNING LEFT)

URETHRA
PROSTATE
PROBE TIP
(TUNRING RIGHT)

SELF-ADMINISTERED TWO-HANDLED PROBE FOR TREATING PROSTATITIS

This U.S. patent application claims the priority of U.S. Provisional Application 60/328,936 filed on Oct. 10, 2001, entitled "Self-Operated Probe for Treating Prostatitis", with inventor in common with the present application.

TECHNICAL FIELD

This invention generally relates to a device and method for self-administered treatment of prostatitis, and more particularly, to a two-handled vibrator probe for precise massaging of the prostate to discharge fluid.

BACKGROUND OF INVENTION

Chronic prostatitis is a disorder in which fluid accumulates or becomes congested in the male prostate gland and may become subject to bacterial infection. Persistence of this condition can lead to the prostate becoming cancerous. Some urologists believe that the most effective treatment for such prostatitis is to massage the prostate at regular intervals to stimulate it to discharge accumulated fluid. For example, in the book *The Prostatitis Syndrome*, by Bradley R. Hennenfent, President of the Prostatitis Foundation, regular prostatic drainage is promoted for long term medical treatment of bacterial prostatitis, non-bacterial prostatitis, prostatodynia, benign prostatic hyperplasia (BPH), sexual dysfunction, and possibly preventing prostate cancer.

In conventional treatment to effect prostatic drainage, the physician or assistive person simply inserts a gloved finger into the rectum and strokes the surface areas of the prostate very gently in sweeping movements toward the urethra, i.e., the direction of prostatic drainage. This serves to relieve the symptoms of chronic prostatitis by draining accumulated prostatic fluid from the glands and ducts. Prostatic drainage is done to completely empty the prostate gland of fluids and to relieve obstructed prostatic duct. A vibrator probe may be used in place of or in addition to the finger massage method, as it appears to have a greater effect on relaxing the prostate tissue and promoting drainage. Although commonly referred to as "prostatic massage", prostatic drainage is a far more complete procedure diagnostically and therapeutically than prostatic massage.

The need for regular and repeated prostatic drainage can require frequent visits to the doctor's office, which incurs a considerable expense and inconvenience to the patient. It is therefore desirable for a patient to have a way to carry out regular prostatic massaging himself. As illustrated in FIG. 9, self-administered prostatic massaging can be carried out using an elongated vibrator probe of the type commonly available as a personal appliance. However, the conventional vibrator requires manipulation of the probe stem with one hand from the rear of the patient. The probe must be inserted in the opening of the rectum with its tip adjacent the colon walls proximate the center of the prostate gland, then manipulated in precise sweeping movements over the surface areas of the prostate gland on each side of the urethra duct from the bladder in order to stimulate a discharge of fluid from the prostate gland through the penis. Manipulating the probe with one hand from one side of the body without being able to see its positioning and without being able to apply balanced forces in all directions is very difficult and, if not done correctly, can cause pain or injury to the rectum, colon, or prostate.

In U.S. Pat. Nos. 2,477,666 and 2,478,786 to Smallen, a hook-shaped prostate gland massaging implement is disclosed which can be inserted and manipulated from the front side of the patient. However, the hooked shape makes it difficult for the patient to translate movements at the front side of the body into effective sweeping movements over the prostate gland at the rear side and interior of the body. In U.S. Pat. No. 4,002,164 to Bradley, a prostate massager is disclosed which has a probe attached to the end of a U-shaped bar with a handle that can be manipulated from the front side of the patient. A toggle line is arranged inside the bar extending to the probe which, when pulled, causes the probe tip to bend slightly to effect a sweeping movement over the prostate. Once the probe is inserted in the rectum, the bar may be rotated back-and-forth to rotate the probe tip and add to the massaging action. Again, with such device, it is difficult to translate movements at the front side of the person's body while pulling on a toggle line into precise and effective sweeping movements of the probe tip over the surfaces of the prostate gland.

It is therefore a principal object of the present invention to provide an apparatus which enables a person to carry out self-administered massaging of the prostate with precise control and balanced sweeping movements to stimulate and cause effective discharge of fluid from the congested prostate. It is a further object of the present invention to provide a method of self-operable treatment for prostatitis which is safe, easy to use, and relatively inexpensive.

SUMMARY OF INVENTION

In accordance with the present invention, a probe apparatus comprises:

a pair of opposing handle bars symmetrical to each other and connected to a center housing along a common axis, said handle bars having handle grip ends extending perpendicularly to the common axis in a forward direction; and a probe connected to a front side of the center housing and extending to a probe tip in the forward direction.

In a preferred embodiment, the center housing includes a vibrator motor which is mechanically coupled to vibrate the probe tip. An actuator switch for the vibrator motor is provided on one of the handle grip ends. The probe has a swivelable tip, and a pair of probe swivel actuators are provided on the handle grip ends for swiveling the probe tip in opposite directions. The probe swivel actuators are in the form of toggle levers coupled by wire cables to a swivel actuator gear in the center housing. The probe tip has an off-center bulbous or ovoid shape for effecting a sweeping movement from one side toward the other in one direction or the other when one of the probe swivel actuators is actuated. The probe and the handle grip ends have approximately the same length and extend in the same forward direction so as to lie along a common axis and in a common plane for more precise manipulation by the patient. The handle bars are connected to the center housing by twist-lock disconnectors to be detachable for storage or packing.

The invention encompasses a method of using the probe apparatus for self-administered treatment of prostatitis by a patient. The probe is inserted into the rectum from the rear of the patient and the probe tip is positioned adjacent the colon walls proximate the prostate while gripping the handle grip ends of the handle bars on each lateral side of the patient, so that the probe can be manipulated to massage the prostate. The patient employs the probe apparatus in a standing, bent over position, and a mirror is placed on the floor between the patient's feet to provide visual confirmation of the position of the probe.

The invention also encompasses a method of using the probe apparatus for self-administered prostatitic drainage. The probe swivel actuators on the handle grip ends of the probe apparatus are manipulated to effect sweeping movements over the surface areas of the prostate toward the prostate center in order to effect drainage of fluid from the prostate gland and ducts.

Other objects, features, and advantages of the present invention will be explained in the following detailed description of the invention having reference to the described drawings.

DETAILED DESCRIPTION OF INVENTION

A preferred embodiment of an improved apparatus and method of self-administered treatment of prostatitis is described in detail below. However, it is to be understood that other embodiments utilizing the disclosed principles of the invention and other variations thereon are considered to be included within the present invention.

With the invention, a prostatitis patient can, after initial treatment and training by a doctor, self-administer regular prostatic massages to continue long term treatment at home. The essential apparatus has a vibrator probe mounted from a center housing with two connecting handle bars extending on each side of the body, to allow the patient to manipulate the probe with precise movements with leverage using both hands in order to apply balanced forces to control the probe in sweeping movements over the surface areas of the prostate. The patient can manipulate the handle bars while standing in a bent-forward position over a mirror for visual feedback on the positioning of the probe. The standing, bent-forward position facilitates downward flow of fluid from the prostate and out through the urethra. The device was developed primarily for effective self-administered treatment of prostatitis, however, it may also be used for other purposes.

Figure 1:
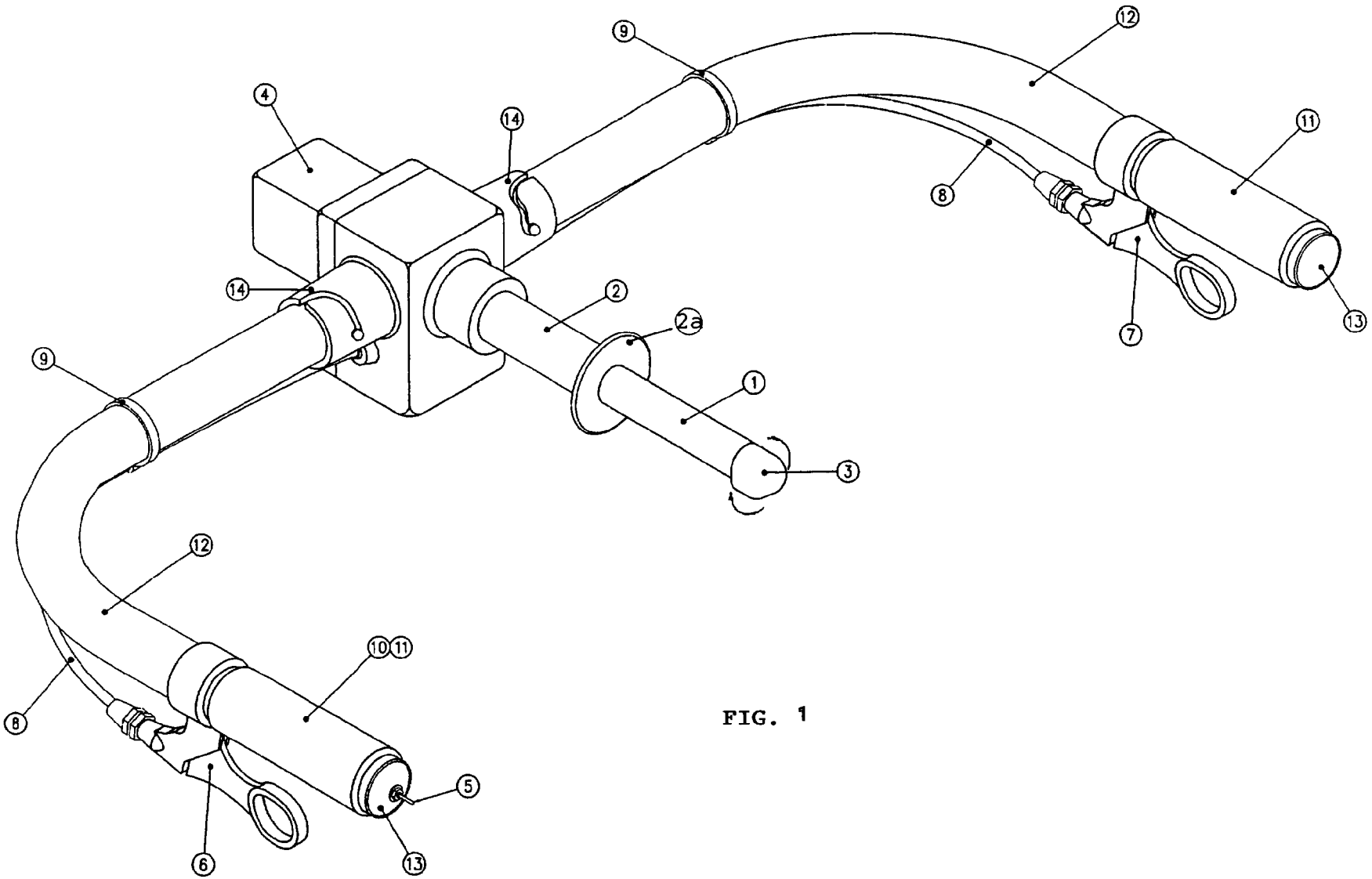
FIG. 1 is a perspective view of a preferred embodiment of the probe apparatus for self-administered treatment of prostatitis in accordance with the present invention.

Referring to FIG. 1, a preferred embodiment of a two-handled vibrator probe is shown for self-administered massaging of the prostate in accordance with the present invention. A vibrator probe 1 having a vibrator stem 2 and a probe tip 3 is mounted to a center housing 4 for the vibrator motor and gear case. In use, the probe and tip is covered with an elastic prophylactic condom cover sleeved over the probe 3 and the backstop 2*a* provided between the probe and the vibrator stem 2. The backstop 2*a* serves to prevent probe insertion beyond what is necessary and safe. The condom cover provides sanitized protection for the colon and the probe. It can be held in place with an elastic holding ring behind the backstop 2*a*. The vibrator motor is actuated by a switch 5 on the end of one (here, the right side) of two handle bars 12 with hand grips 11 which are connected to the center housing 4. A battery 10 for supplying power to the vibrator motor may be housed within the hand grip 11 on the right side where the vibrator switch 5 is located. The hand grips 11 have end caps 13 which may be opened to access the interior of the hollow tubing forming the hand grips 11. A right-side probe swivel actuator 6 is mounted to the right side handle bar, and a left-side probe swivel actuator 7 is mounted to the left side handle bar in positions where they can be controlled by the patient's finger on each hand. The probe swivel actuators 6, 7 are coupled by actuator cables 8 (held in place by retainer clips 9) to a gearing for swiveling the probe (to be described in further detail below) within the center housing 4. The handle bars 12 are detachable from the center housing 4 using twist-lock disconnectors 14 for storage or convenient packing.

The probe has a cylindrical tubular shape with a rounded off-center tip shape which allows the patient to generate a sweeping movement for sweeping an area around the axis of rotation when the probe tip is swiveled, rather than a drilling movement. The handle bars can be hollow tubular bars made of a light weight metal such as aluminum. The left and right handle bars are symmetric and located with the same spacing on opposite sides of the probe. The probe tip and the handle grips are configured to have the same length and extend perpendicularly to a common lateral axis and lie in a common plane. With the probe inserted in the colon, the motion of the tip will be identical to the patient's manipulation of the handle bar grips. This gives the patient a clear visualization of the positioning and movement of the probe internally. The probe swivel actuators adjacent each hand grip allow the patient to readily control the movement of the probe's off-center tip to sweep over the surface of the prostate around one side and toward the prostate center. The vibrator switch can be conveniently actuated from the right hand grip. Another electrical control, such as a probe tip sensor for testing the mass or density of the prostate, may be placed on the left hand grip. The vibration motor is housed at the base as near as possible to the probe assembly in order to transmit the vibrations effectively to the probe.

Figure 2:
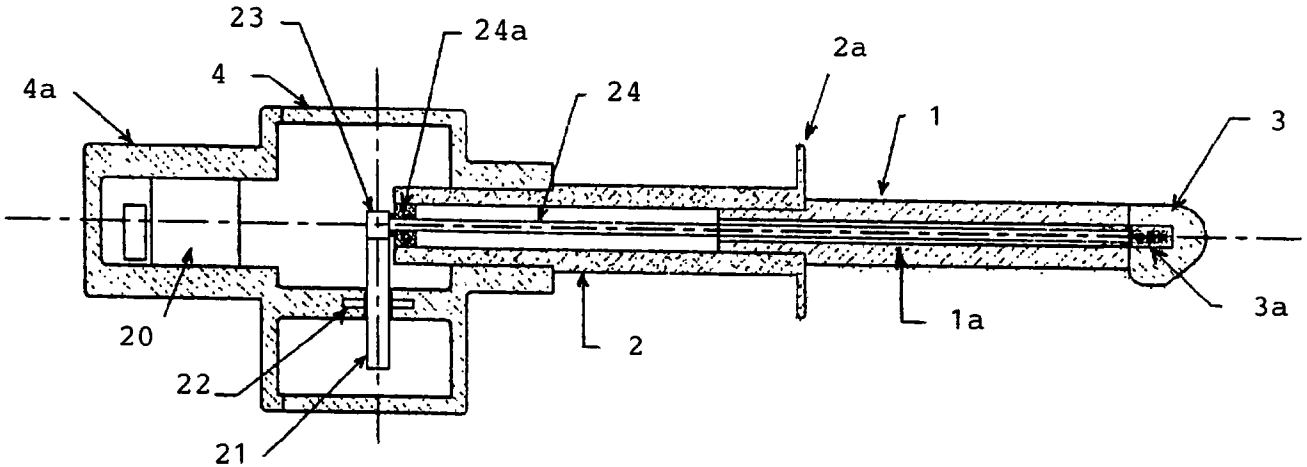
FIG. 2 is a side sectional view of the vibrator probe in the preferred embodiment.
Figure 3:
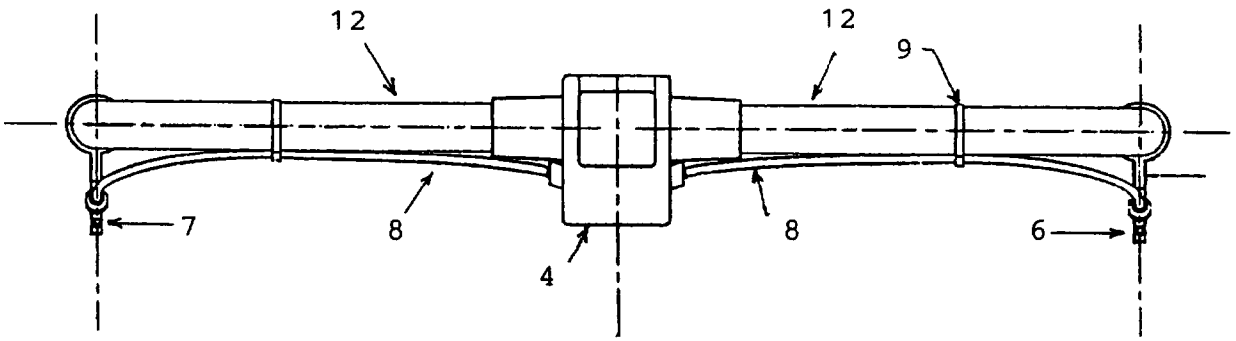
FIG. 3 is a rear view of the probe apparatus.

In FIG. 2, the vibrator probe 1 is shown in side sectional view with its back end seated against the backstop 2*a* of the vibrator stem 2, which is seated within the center housing 4. The housing 4 has a gear case cover assembly 4*a* for retaining and providing access to the vibrator motor and gear case component 20 contained therein. The vibrator motor and gear case component 20 produce small vibrations (at one or more levels) which are applied to the end of the vibrator stem 2 within the housing 4 and transmitted through the probe 1 to its tip 3. As illustrated in FIG. 3, the probe tip 3 is swiveled in back-and-forth sweeping movements by finger pulls on the right and left probe swivel actuators 6, 7 on the ends of the handle bars 12 which are coupled by the actuator cables 8 to the swivel actuator gear 21 in the center housing 4. The swivel actuator gear 21 is rotatable on a shaft 22 and geared with meshed teeth to a probe swivel gear 23. The probe swivel gear 23 is coupled to a probe pivot shaft 24 journalled on a shaft bearing assembly 24*a* and extending through the probe interior 1*a* to the probe tip 3 through a tip bearing assembly 3*a*.

Figure 4:
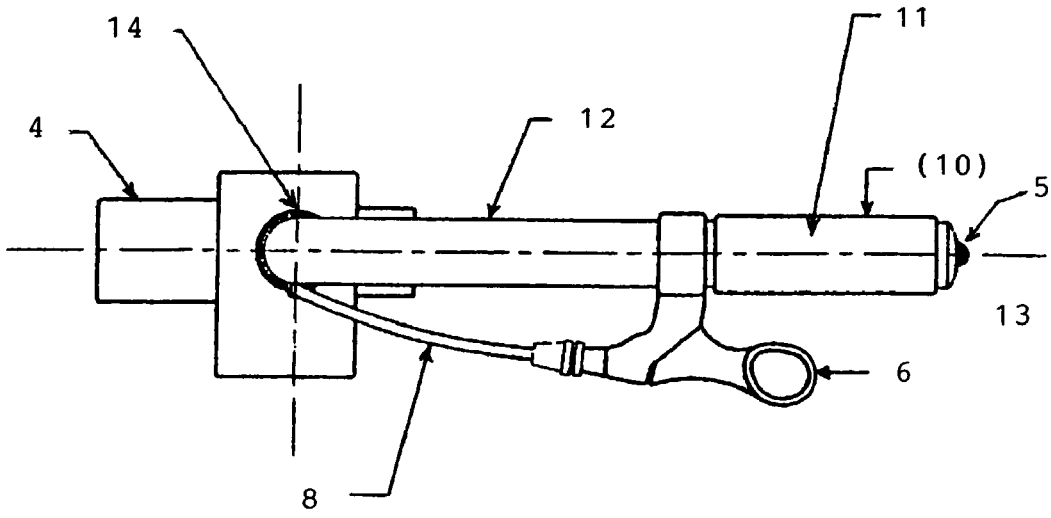
FIG. 4 is a right side view of the probe apparatus.
Figure 5:
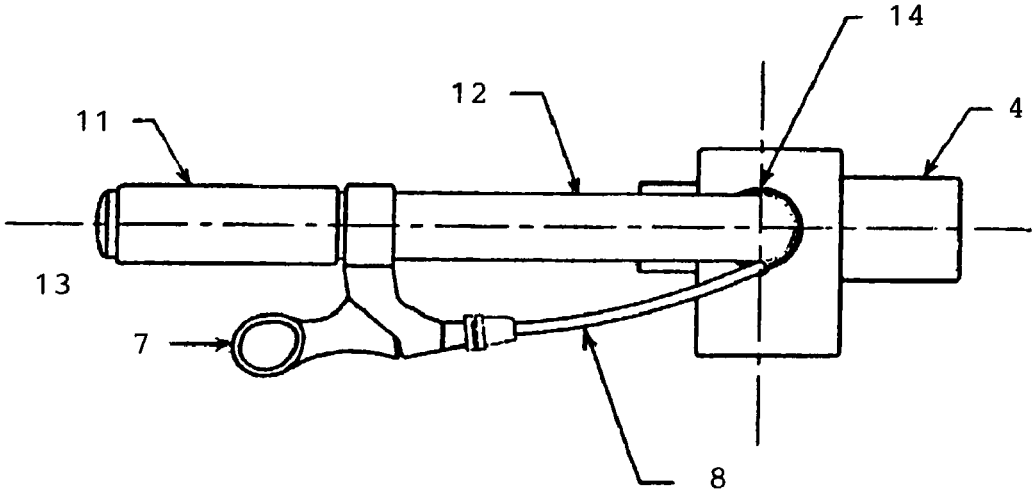
FIG. 5 is a left side view of the probe apparatus.

In FIGS. 4 and 5, the right and left probe swivel actuators 6, 7 are shown in greater detail mounted on the ends of the handle bars 12 where their toggle levers can be actuated by finger pulls as the patient holds onto the handle grips 11. The toggle levers pull on the actuator cables 8 in a manner similar to bicycle hand brakes. The cables 8 lead into the center housing 4 through a recess formed in conjunction with the twist-lock disconnectors 14 coupling the handle bars to the housing. The vibrator switch 5 is also positioned on the end of the hand grip 11 of the right side handle bar, and the battery 10 is stored within the hand grip 11 and accessed through the end cap 13.

Figure 6:
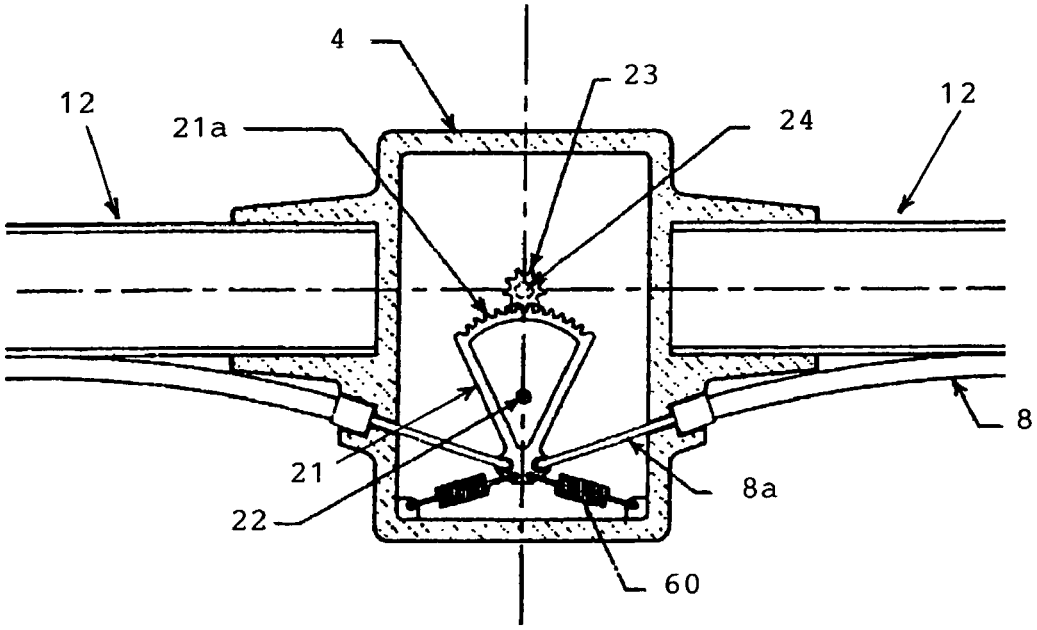
FIG. 6 is a sectional view of the center housing of the probe apparatus.

In FIG. 6, the swivel actuator gear 21 is shown mounted to be pivotable on the pivot shaft 22 and having one end connected to the ends of the cables 8 coupled to the right and left probe swivel actuators. The cable-connected end is biased in a neutral position by the retractor springs 60. Pulling on one or the other of the cables 8 causes its end 8*a* to pull on the cable-connected end of the swivel actuator gear 21 and causes its opposite, geared end 21*a* to pivot in the opposite direction. The geared end 21*a* is meshed with the probe swivel gear 23 and causes it to rotate in the opposite direction that the geared end 21*a* is pivoted. The probe swivel gear 23 is coupled to the probe swivel shaft 24 which is coupled to the probe tip and causes it to swivel in the corresponding direction.

Figure 7A:
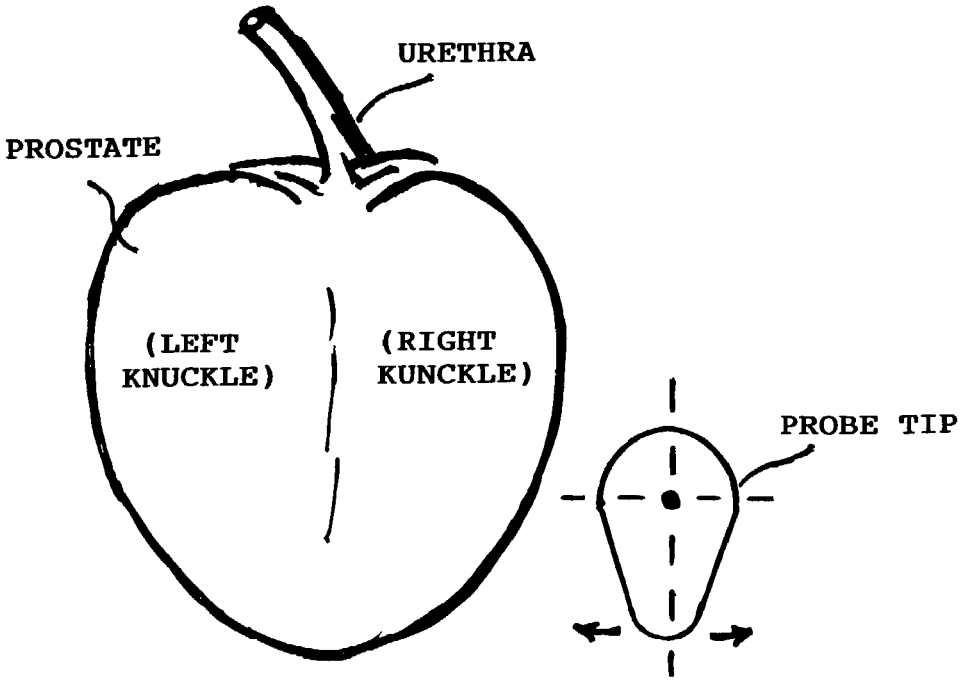
FIG. 7A shows the prostate adjacent the probe tip.
Figures 7B, 7C, 7D, 7E, 7F, 7G, 7H, 7I:
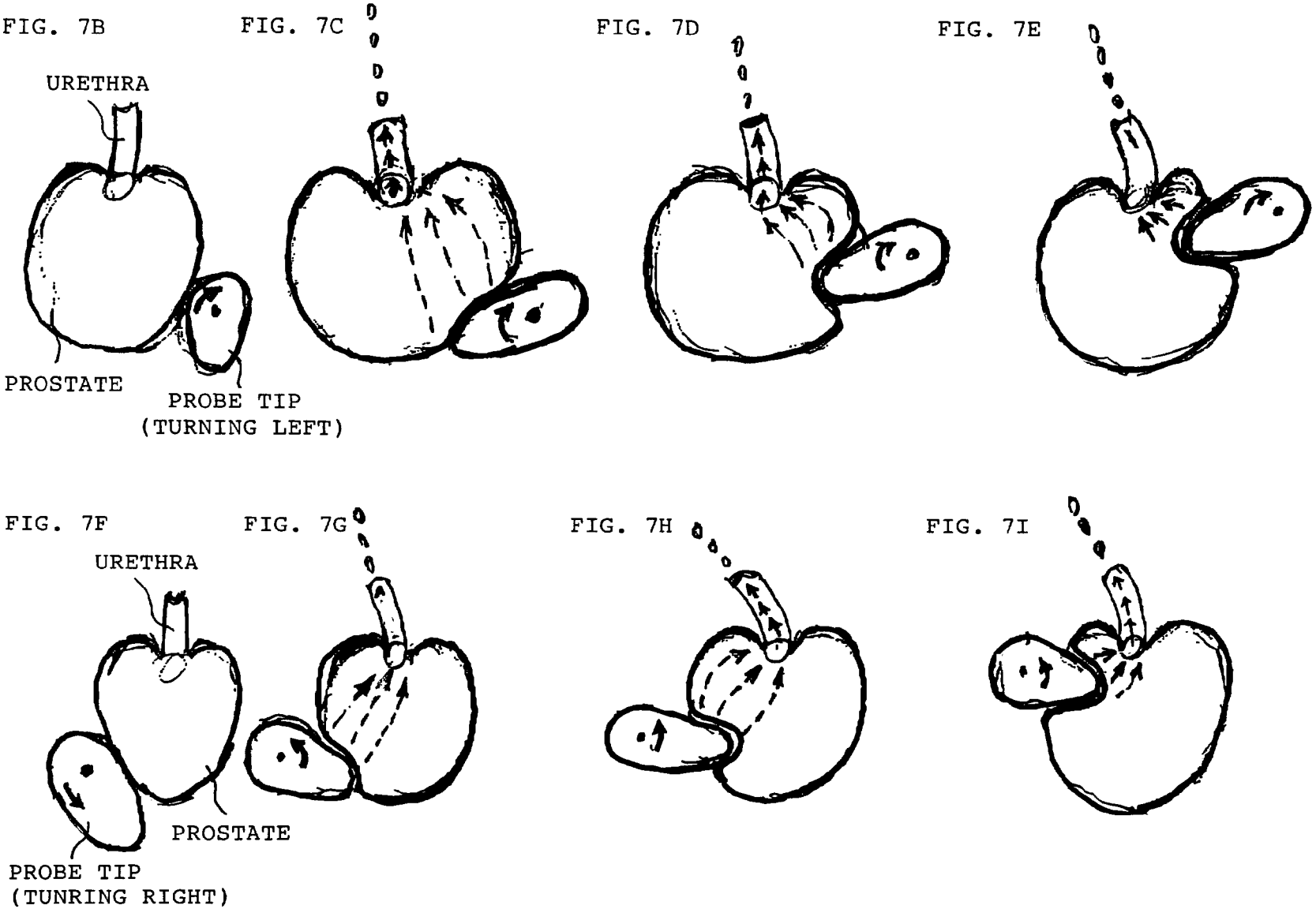
FIGS. 7B–7E shows massaging the prostate by turning the probe tip left.
FIGS. 7F–7I shows turning the probe tip right.

As illustrated in FIG. 7A, the prostate gland has a shape similar to a walnut with left knuckle and right knuckle portions that secrete seminal fluid through ducts into the urethra from the urinary bladder. The probe tip is shown (in cross section) adjacent the prostate for comparison, having a cross section that is bulbous on one end or generally ovoid in shape. The ovoid shape facilitates pushing on the prostate walls to move accumulated fluid into the ducts of the prostate and into the urethra when the probe tip is turned to the right or to the left. The walnut-shaped prostate gland is slightly harder in texture than the colon walls. The two knuckle portions are positioned on each side of the urethra, and are reference stop positions during massaging to minimize making contact with the urethra, since pressing on the urethra could result in slight irritation and subsequent discomfort. The preferred method of use allows compression of the prostate by pressing on its top surfaces with the patient standing in the bent-over position. This involves inserting the probe with its eccentric shaped tip through the rectum and making contact with the top surfaces of the prostate on the left and right knuckle portions, respectively. Simultaneous inward and upward movement of the probe tip by manipulating the two-handled apparatus while swiveling the probe tip (using the swivel actuators) in sweeping movements against the top surfaces will press fluid from the prostate and out through the urethra.

FIGS. 7B–7E show the probe tip positioned adjacent the right knuckle of the prostate and being turned to the left as the probe tip is moved alongside the prostate in a slight sweeping movement to push fluid toward the upper ducts leading to the urethra. Similarly, FIGS. 7F–7I show the probe tip positioned adjacent the left knuckle of the prostate and being turned the right as it is moved in a sweeping movement to the left. The vibrator motor may be turned on at the same tip to vibrate the probe tip and loosen and urge fluid from the prostate tissues and ducts. In this manner, the patient can control the vibration, turning, and sweeping movements of the probe tip over the surface areas of the prostate to accomplish a more complete draining of fluid from the prostate.

Figure 8:
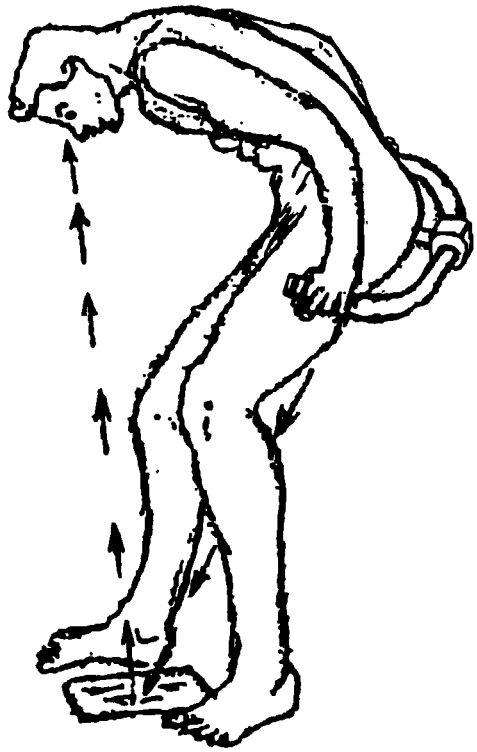
FIG. 8 is a a diagram illustrating the preferred method of using the probe apparatus for massaging the prostate.
Figure 9:
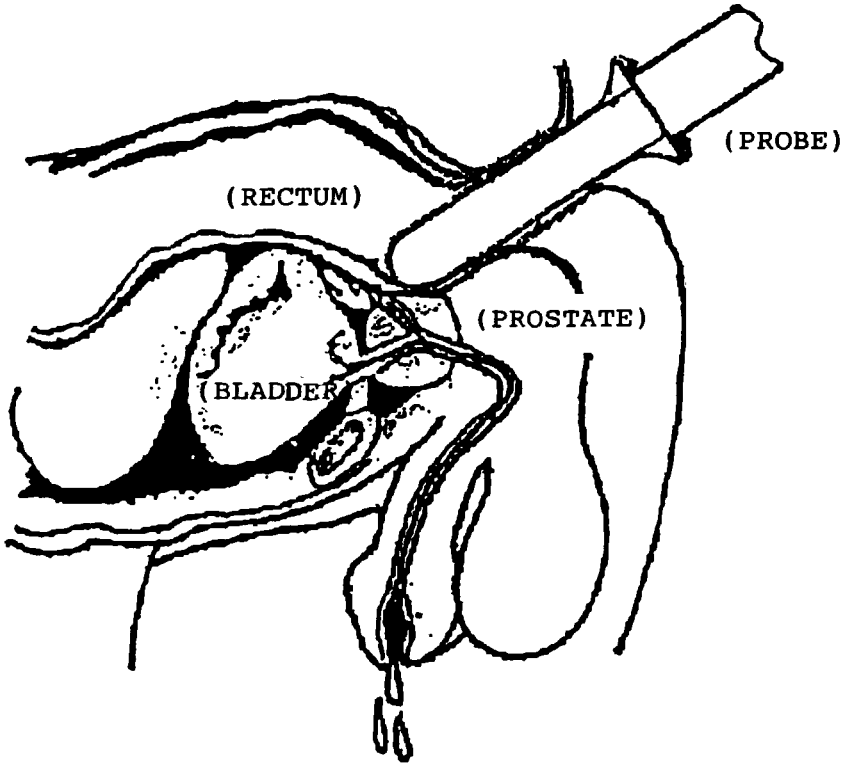
FIG. 9 is a a diagram illustrating the internal positioning and use of the probe relative to the prostate.

In FIG. 8, the preferred method of using the two-handled vibrator probe for precise control of massaging the prostate is illustrated. The patient employs the probe from the rear holding the handle bar grips in each hand. A mirror is placed on the floor between the person's feet to show a reflection of the probe's position behind the body. The patient stands in a bent-forward position over the mirror for visual confirmation of the positioning of the probe. The standing, bent-forward position also facilitates downward flow of fluid from the prostate and out through the urethra. As shown in FIG. 9, the probe must enter the rectum at the proper angle: center alignment is critical, and so is control of its side to side movement. Precise control of the probe is facilitated by the leverage the patient can exert on the two handle bars with each hand in a reciprocal fashion that balances the forces exerted by each hand. The positioning of the handle bar grips in a horizontal plane and located symmetrically on each side at the hips of the patient ensures that he can precisely orient, position, and angle the probe tip relative to the ground and to the axis of his hips. The length of the handle bar ends and grips is designed to be similar in length to and in the same plane as the probe and perpendicular to the common lateral axis. Symmetry in configuration and the balancing of position and forces are critical to the patient being able to judge how to manipulate the handle bars externally in order to precisely position the probe tip around the surface areas of the prostate. The patient can readily actuate the vibrator and swivel the probe tip in controlled movements.

The correct positioning of the probe in the rectum and in contact with the prostate and the proper use of the vibrator tip and manipulation of the probe in sweeping movements over the prostate to achieve prostatic drainage is explained by a doctor during one or more training sessions. The patient can then self-administer massaging the prostate for prostatic drainage on a regular basis at home, thereby avoiding frequent, costly, and inconvenient visits to the doctor's office.

It is understood that many modifications and variations may be devised given the above description of the principles of the invention. It is intended that all such modifications and variations be considered as within the spirit and scope of this invention, as defined in the following claims.

The invention claimed is:

1. A probe apparatus for massaging the prostate area of a male user for treating a prostate condition, comprising:

a pair of opposing handle bars extending transversely a distance sufficient to span the girth of the user's waist symmetrical to each other for manipulation with the user's hands on each side of the waist, and being connected to a center housing positioned proximate the buttocks of the user along a vertical body axis of the user, said handle bars having handle grip ends extending perpendicularly to the vertical body axis in a forward direction of the user; and a probe connected to the center housing and extending to a probe tip adapted to be inserted in the user's anus and positioned in contact with the prostate area for massaging it to treat the prostate condition.

2. A probe apparatus according to claim 1, wherein the center housing includes a vibrator motor, and the probe is mechanically coupled to receive vibrations generated by the vibrator motor.

3. A probe apparatus according to claim 2, wherein an actuator switch for the vibrator motor is provided on one of the handle grip ends and is electrically coupled to the vibrator motor.

4. A probe apparatus according to claim 1, wherein the probe has a swivelable probe tip, and a pair of probe swivel actuators are provided respectively on each of the handle grip ends and connected through a mechanical coupling to the probe tip for swiveling it in opposite swivel directions.

5. A probe apparatus comprising:

a pair of opposing handle bars symmetrical to each other and connected to a center housing along a common axis, said handle bars having handle grip ends extending perpendicularly to the common axis in a forward direction; and a probe connected to a front side of the center housing and extending to a probe tip in the forward direction, wherein the probe has a swivelable probe tip, and a pair of probe swivel actuators are provided respectively on each of the handle grip ends and connected through a mechanical coupling to the probe tip for swiveling it in opposite swivel directions, wherein the probe swivel actuators are provided in the form of toggle levers which are coupled by wire cables to a pivotable swivel actuator gear in the center housing that drives the swivelable probe tip.

6. A probe apparatus according to claim 4, wherein probe tip has an off-center bulbous or ovoid shape for effecting a sweeping movement from one side toward the other in one direction or the other when one of the probe swivel actuators is actuated.

7. A probe apparatus according to claim 1, wherein the probe and the handle grip ends have approximately the same length and extend in the same forward direction so as to lie along a common axis and in a common plane.

8. A probe apparatus according to claim 1, wherein the handle bars are connected to the center housing to be detachable therefrom for storage or packing.

9. A probe apparatus according to claim 8, wherein the handle bars are connected to the center housing through twist-lock disconnectors.

* * * * *